US007609106B2

(12) United States Patent
Watanabe

(10) Patent No.: US 7,609,106 B2
(45) Date of Patent: Oct. 27, 2009

(54) CONSTANT CURRENT CIRCUIT

(75) Inventor: Yasuhiro Watanabe, Kanagawa (JP)

(73) Assignee: NEC Electronics Corporation, Kawasaki, Kanagawa (JP)

( * ) Notice: Subject to any disclaimer, the term of this patent is extended or adjusted under 35 U.S.C. 154(b) by 91 days.

(21) Appl. No.: 11/892,605

(22) Filed: Aug. 24, 2007

(65) Prior Publication Data

US 2008/0048771 A1 Feb. 28, 2008

(30) Foreign Application Priority Data

Aug. 28, 2006 (JP) ..... 2006-230691

(51) Int. Cl.
*G05F 1/10* (2006.01)

(52) U.S. Cl. ..... 327/539; 323/313

(58) Field of Classification Search ..... 327/539; 323/313

See application file for complete search history.

(56) References Cited

U.S. PATENT DOCUMENTS

| | | | | |
|---|---|---|---|---|
| 4,942,369 | A | 7/1990 | Nakagawara et al. | |
| 5,880,582 | A | 3/1999 | Sawada | |
| 6,087,820 | A | 7/2000 | Houghton et al. | |
| 6,448,811 | B1 | 9/2002 | Narendra et al. | |
| 6,501,299 | B2 * | 12/2002 | Kim et al. | 326/83 |
| 6,768,139 | B2 * | 7/2004 | Fischer et al. | 257/185 |
| 7,276,890 | B1 * | 10/2007 | Kumar | 323/313 |
| 2002/0125938 | A1 * | 9/2002 | Kim et al. | 327/539 |
| 2003/0102901 | A1 | 6/2003 | Ooishi | |
| 2003/0132796 | A1 | 7/2003 | Gailhard et al. | |
| 2004/0150381 | A1 * | 8/2004 | Butler | 323/313 |

FOREIGN PATENT DOCUMENTS

| | | | |
|---|---|---|---|
| EP | 0 651 311 | A2 | 5/1995 |
| JP | 4-170609 | | 6/1992 |
| JP | 8-63245 | | 3/1996 |
| JP | 8-228114 | A | 9/1996 |
| JP | 2000-330658 | A | 11/2000 |
| JP | 2005-228160 | | 8/2005 |

OTHER PUBLICATIONS

European Search Report dated Oct. 5, 2007.
Korean Office Action dated Feb. 27, 2009 with partial English-Language Translation.

* cited by examiner

*Primary Examiner*—Lincoln Donovan
*Assistant Examiner*—Ryan C Jager
(74) *Attorney, Agent, or Firm*—McGinn IP Law Group, PLLC

(57) ABSTRACT

A constant current circuit includes a first current mirror composed of a first transistor formed on a first current path and a second transistor formed on a second current path, a second current mirror composed of a third transistor formed on the first current path and a fourth transistor formed on the second current path, a first diode formed on the first current path, a second diode formed on the second current path, a resistor formed on the second current path, a variable resistance element connected with the first current path and with the second current path, and a feedback unit to control a resistance value of the variable resistance element based on a current flowing through the second current path.

14 Claims, 7 Drawing Sheets

CONSTANT CURRENT CIRCUIT

BACKGROUND OF THE INVENTION

1. Field of the Invention

The present invention relates to a constant current circuit that supplies a stable output current.

2. Description of Related Art

A band-gap reference circuit is known as a constant current circuit that is widely used in a semiconductor integrated circuit. The band-gap reference circuit is independent of power supply voltage fluctuation or process fluctuation of MOS transistors.

The technique related to the band-gap reference circuit is disclosed in Japanese Unexamined Patent Application Publication No. 8-63245 (Koyabe). FIG. 6 shows the technique disclosed in Koyabe. The technique taught by Koyabe includes P-channel MOS transistors (PMOS) P51 to P53, N-channel MOS transistors (NMOS) N51 and N52, a resistor R51, and diodes D51 and D52. The PMOS P51, the NMOS N51 and the diode D51 are connected in series between a power supply and a ground. The PMOS P52, the NMOS N52, the resistor R51 and the diode D52 are also connected in series between the power supply and the ground. The PMOS P51 and the PMOS P52 form a first current mirror. The NMOS N51 and the NMOS N52 form a second current mirror. The first current mirror and the second current mirror form a loop. The area ratio of the diode D51 and the diode D52 is 1:N. The NMOS N51, the NMOS N52, the PMOS P51 and the PMOS P52 have the same transistor size, and they operate in a saturation region. The terminal "a" is a power supply terminal, "b" is an output terminal, and "c" is a ground terminal.

Because the NMOS N51 and the NMOS N52 form a current mirror, gate-source voltages Vgs of N51 and N52 are equal, so that a voltage VA at a point A and a voltage VB at a point B are equal. Therefore, a voltage drop at the resistor R51 is determined by a difference between the diodes D51 and D52. Thus, a current I52 is determined by a difference between the voltage VA at the point A and a voltage VC at a point C, which is VA−VC. The current I52 is independent of the characteristics of MOS transistors and a power supply voltage because $I52=I51=(kT/q)\log(N)/R51$ where k is Boltzmann constant, q is elementary charge, and T is temperature.

However, the current I52 varies with process fluctuation in resistance of the resistor R51. As the current I52 varies, an output current I53 which forms a current mirror with the current I52 also varies by process fluctuation in resistance of the resistor R51. The technique to overcome this drawback is disclosed in Japanese Unexamined Patent Application Publication No. 4-170609 (Kameyama). FIG. 7 shows the technique disclosed in Kameyama. The technique taught by Kameyama uses an NMOS N53 instead of the diodes D51 and D52 used in Koyabe and further includes a feedback unit 60 having a PMOS P53, an NMOS N54 and an NMOS N55. The terminal "a" is a power supply terminal, "b" is an output terminal, and "c" is a ground terminal.

As in Koyabe, the current I52 is determined by a voltage applied to the resistor R51. If the current I52 increases, the current I53 increases accordingly. The voltage at the NMOS N54 is lower than the voltage at the point A, and a voltage difference between the point A and the NMOS N54 is fed back to the NMOS N53. As a result, the voltage at the point A decreases. The voltages of the point A and the point B are equal because of a current mirror, and therefore the voltage at the point B decreases as the voltage at the point A decreases. Consequently, the current I52 is suppressed, and the output current I54 is thereby also suppressed. In this manner, Kameyama uses the feedback unit 60 to control the current fluctuation which occurs due to variations of a gate length Lg, a gate width Wg and a threshold Vt of each MOS transistor and a resistance.

However, although the technique disclosed in Kameyama can supply a stable output current for power supply voltage fluctuation and process fluctuation of each MOS transistor, it cannot supply a stable current for temperature fluctuation because it does not use a temperature compensating circuit or the like which uses a diode and a resistor as in Koyabe.

SUMMARY

In one embodiment, a constant current circuit includes a first current mirror including a first transistor formed on a first current path and a second transistor formed on a second current path, a second current mirror including a third transistor formed on the first current path and a fourth transistor formed on the second current path, a first diode formed on the first current path, a second diode formed on the second current path, a resistor formed on the second current path, a variable resistance element connected with the first current path and with the second current path, and a feedback unit to control a resistance value of the variable resistance element based on a current flowing through the second current path.

According to the embodiment, the constant current circuit includes the variable resistance element which is connected with the first current path and with the second current path. It controls a resistance value of the variable resistance element according to a voltage which is fed back from the feedback unit, thereby controlling a current flowing through the second current path.

The constant current circuit of the present invention enables supply of a stable output current with a bias circuit having a small dependence on power supply voltage fluctuation, temperature fluctuation, process fluctuation of MOS transistors and a resistor.

BRIEF DESCRIPTION OF THE DRAWINGS

The above and other objects, advantages and features of the present invention will be more apparent from the following description of certain preferred embodiments taken in conjunction with the accompanying drawings, in which.

DETAILED DESCRIPTION OF PREFERRED EMBODIMENTS

The invention will be now described herein with reference to illustrative embodiments. Those skilled in the art will recognize that many alternative embodiments can be accomplished using the teachings of the present invention and that the invention is not limited to the embodiments illustrated for explanatory purposes.

First Embodiment

Figure 1:
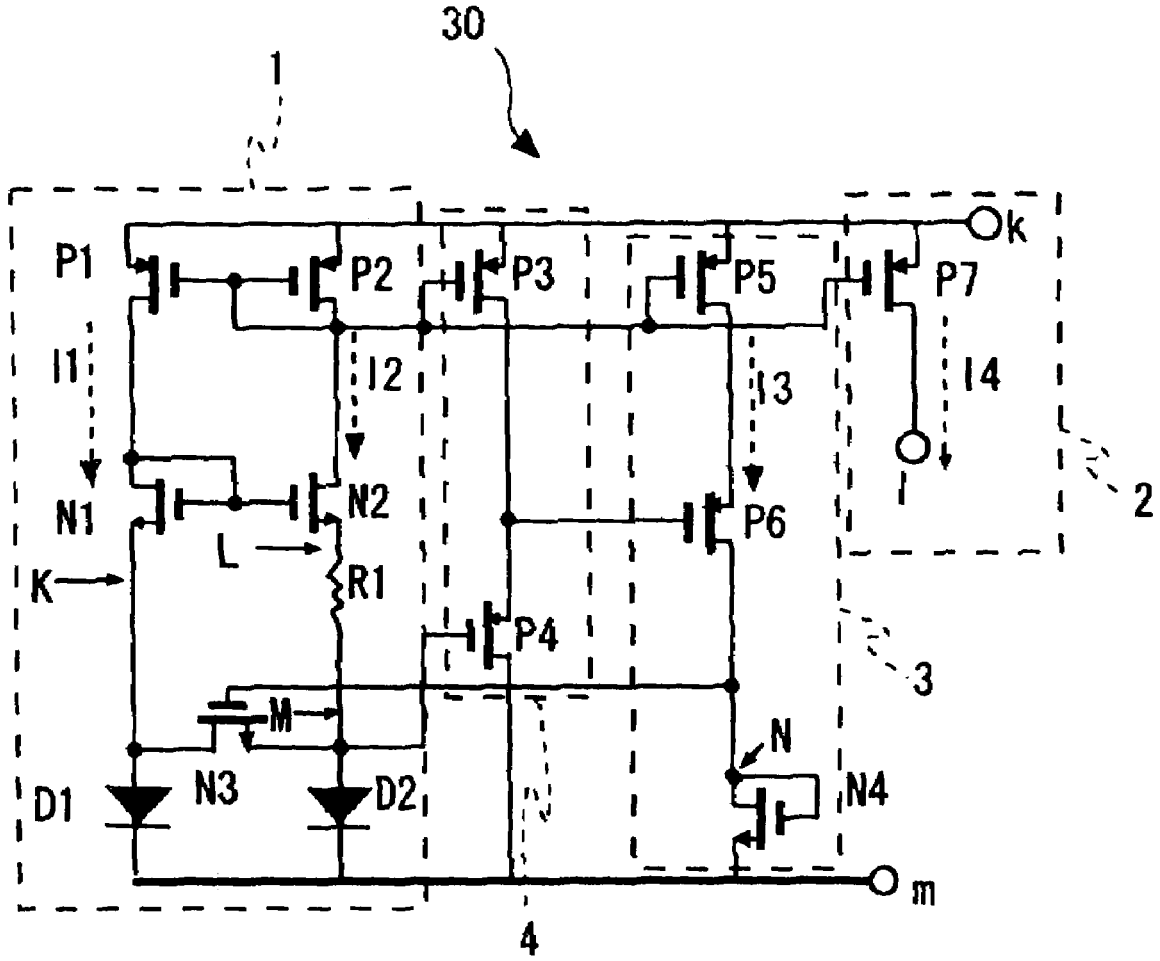
FIG. 1 is a circuit diagram showing a constant current circuit using an inverter circuit according to an embodiment of the present invention.

A first embodiment of the present invention is described hereinafter in detail with reference to FIG. 1. FIG. 1 is a circuit diagram showing a constant current circuit 30 according to this embodiment. As shown in FIG. 1, the constant current circuit 30 includes a band-gap reference circuit 1, a current output unit 2, an inverter circuit 3, and a first level shifter 4. The band-gap reference circuit 1 generates a constant output current regardless of the occurrence of power supply voltage change, process fluctuation, temperature change and so on. The current output unit 2 outputs a current generated in the constant current circuit of this embodiment. The inverter circuit 3 generates and outputs a voltage to be fed back so as to allow the output current of the band-gap reference circuit 1 to remain constant. The first level shifter 4 shifts a voltage at a prescribed node of the band-gap reference circuit 1 and outputs a level-shifted voltage.

The band-gap reference circuit 1 includes PMOS transistors (PMOS) P1 and P2, NMOS transistors (NMOS) N1 to N3, a resistor R1 and diodes D1 and D2. The PMOS P1, the NMOS N1 and the diode D1 are connected in series between a power supply and a ground, forming a first current path. The PMOS P2, the NMOS N2, the resistor R1 and the diode D2 are also connected in series between the power supply and the ground, forming a second current path. The gates of the PMOS P1 and P2 are connected in common with the drain of the PMOS P2, so that they form a first current mirror. The gates of the NMOS N1 and N2 are connected in common with the drain of the NMOS N1, so that they form a second current mirror. The resistor R1 is placed between the NMOS N2 and the anode of the diode D2, and the NMOS N3 is connected between the anode of the diode D1 and the anode of the diode D2. The gate of the NMOS N3 receives an output voltage of the inverter circuit 3, which is described in detail later.

The first level shifter 4 includes a PMOS P3 and a PMOS P4. The PMOS P3 and P4 are connected in series between the power supply and the ground. The PMOS P3 is connected with the PMOS P2 to form a current mirror. The gate of the PMOS P4 receives a voltage at the anode of the diode D2. A voltage between the PMOS P3 and the PMOS P4 is input to the inverter circuit 3.

The inverter circuit 3 includes a PMOS P5, a PMOS P6 and an NMOS N4. The source of the PMOS P5 is connected with a power supply terminal, and the drain of the PMOS P5 is connected with the source of the PMOS P6. The gate of the PMOS P5 is connected with the drain of the PMOS P2 to form a current mirror. The PMOS P6 and the NMOS N4 are connected in series between the drain of the PMOS P5 and the ground voltage. The gate of the PMOS P6 is connected with a node between the PMOS P3 and P4.

The current output unit 2 includes a PMOS P7 which is connected between the power supply terminal and the output terminal. The gate of the PMOS P7 is connected with the drain of the PMOS P2 to form a current mirror.

In FIG. 1, the terminal "k" is a power supply terminal, "l" is an output terminal, and "m" is a ground terminal. The PMOS P1 to P7 and the NMOS N1 to N4 in this embodiment have the same transistor size, and they operate in a saturation region. The transistors which form a current mirror in FIG. 1 may form a current mirror by cascode connection. The first level shifter 4 may be eliminated depending on threshold setting of transistors. The area ratio of the diode D1 and the diode D2 is different.

The operation of the constant current circuit 30 according to this embodiment is described in detail hereinbelow. In the following description, the case where a resistance value of the resistor R1 falls below a set value due to process fluctuation is described by way of illustration.

As a resistance value of the resistor R1 decreases, a reference current I2 increases. If the currents flowing through the PMOS P1, P2, P5 and P7 are I1, I2, I3 and I4, respectively, I1, I2, I3, and I4 are equaled. Thus, an increase in the reference current I2 leads to an increase in the current I3 flowing through the PMOS P5.

The increase in the current I3 causes an increase in the current flowing through the PMOS P6 and the NMOS N4. Because the PMOS P6 receives a voltage at the point M through the first level shifter 4, a gate voltage of the PMOS P6 increases.

As the current flowing through the NMOS N4 increases, a voltage drop by the NMOS N4 becomes larger, and a voltage VN at the point N in the inverter circuit 3 increases. The inverter circuit 3 outputs the voltage VN at the point N to the gate of the NMOS N3. Thus, as the voltage VN at the point N increases, the on-resistance of the NMOS N3 decreases, thereby reducing a difference between a voltage VK at the point K and the voltage VM at the point M. Because the current mirror of the PMOS P1 and the PMOS P2 and the current mirror of the NMOS N1 and the NMOS N2 form a loop, a voltage VL at the point L decreases as the voltage VK at the point K decreases. As the voltage VL at the point L decreases, a voltage difference between the point L and the point M is reduced accordingly. Thus, a voltage (VL−VM) to be applied to the resistor R1 decreases. Therefore, an increase in the reference current I2, which is I2=(VL−VM)/R1, is suppressed. Specifically, if process fluctuates to cause an increase in the reference current I2, a feedback voltage from the point N in the inverter circuit 3 increases so as to perform the operation for reducing the reference current I2. As a result, the output current I4 is suppressed and output to the output terminal 1. If a resistance value of the resistor R1 increases, the voltage VN at the point N decreases to increase the on-resistance of the NMOS N3, so that a voltage (VL−VM) to be applied to the resistor R1 increases. The reference voltage I2 and the output current I4 thereby remain substantially constant.

Figure 2:
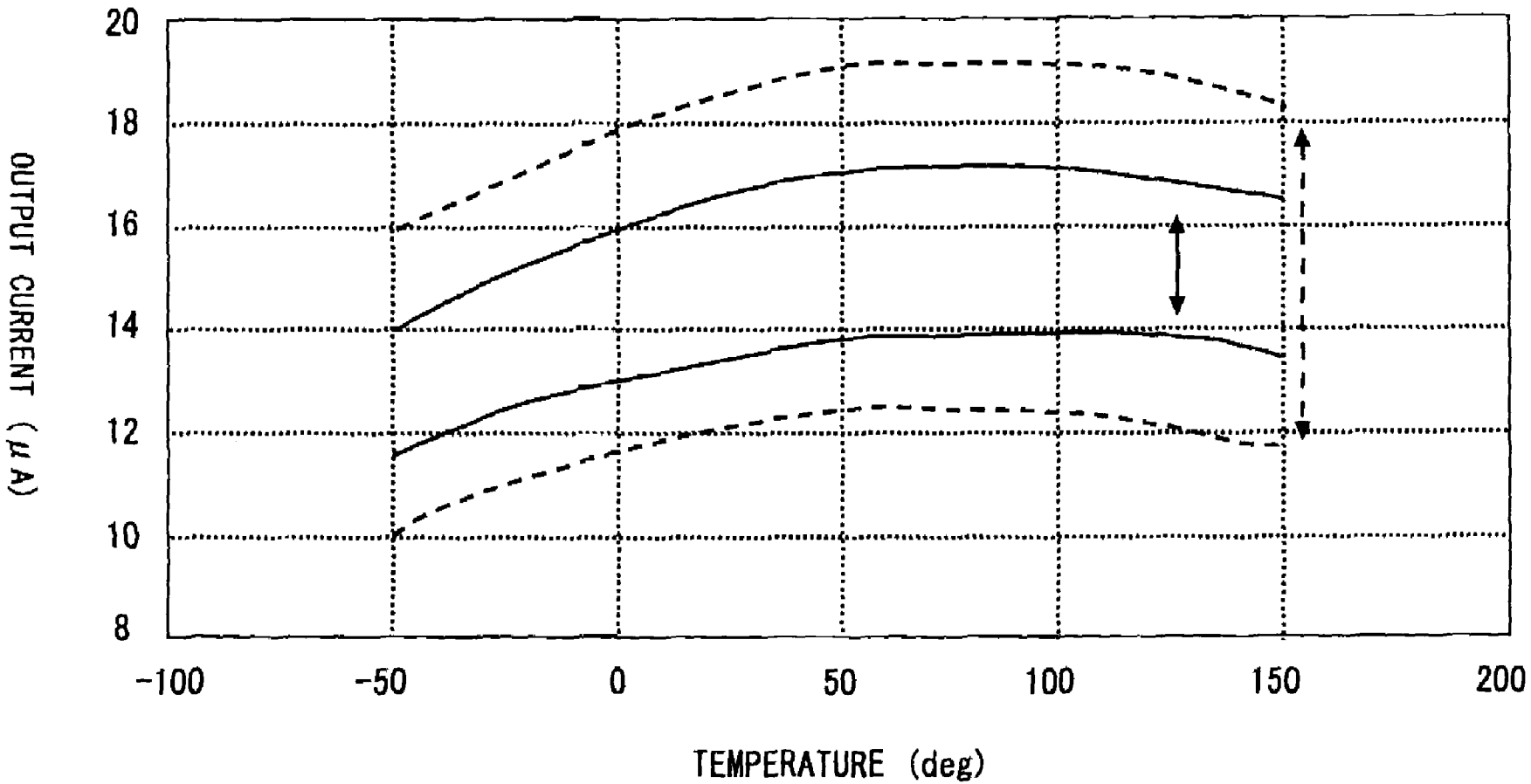
FIG. 2 is a graph showing variation of output currents in a constant current circuit according to an embodiment of the present invention and a constant current circuit according to a related art.

FIG. 2 is a view to show a change in output current with respect to a change in resistance value. In the graph of FIG. 2, the horizontal axis indicates temperature, thus showing a change in output current with respect to temperature as well. In FIG. 2, the solid line and the dotted line in the upper part of the graph respectively indicate output currents when resistance values in the constant current circuit of this embodiment and the constant current circuit of the related art fall below a set value at the same rate. The solid line and the dotted line in the lower part of the graph respectively indicate output currents when resistance values in the constant current circuit of this embodiment and the constant current circuit of the related art exceed a set value at the same rate. This embodiment changes a voltage to be applied to the gate of the NMOS N3 according to a change in output current, thereby changing a voltage to be applied to the resistor R1. It is thus possible to reduce variation of an output current upon fluctuation of a resistance value as shown in FIG. 2.

The band-gap reference circuit 1 of the constant current circuit 30 of this embodiment includes the NMOS N3 that is a variable resistance element which is connected with the first current path composed of the PMOS P1, the NMOS N1 and the diode D1 and also connected with the second current path composed of the PMOS P2, the NMOS N2, the resistor R1 and the diode D2. Further, the constant current circuit 30 includes the inverter circuit 3 that includes the PMOS P5 which forms a current mirror together with the PMOS P2 in the second current path and feeds back an output voltage of the inverter circuit 3 to the NMOS N3. In such a configuration, if process fluctuates to cause an increase in the current I2 which flows through the second current path, an output voltage of the inverter circuit 3 increases according to the current I2. Then, a voltage which is input to the gate of the NMOS N3 increases to thereby reduce a voltage at the point K. The decrease in the voltage at the point K leads to a decrease in a voltage at the point M, so that an increase in the current I2 is suppressed, thereby preventing an increase in the current I4 which is output from the constant current circuit 30. This allows the current output from the constant current circuit 30 to remain substantially constant, thus reducing the dependence of the resistance of the resistor R1 on process fluctuation. It is thereby possible to supply a stable output current, enabling improvement in CMOS circuit characteristics, yield and so on.

Figure 3:
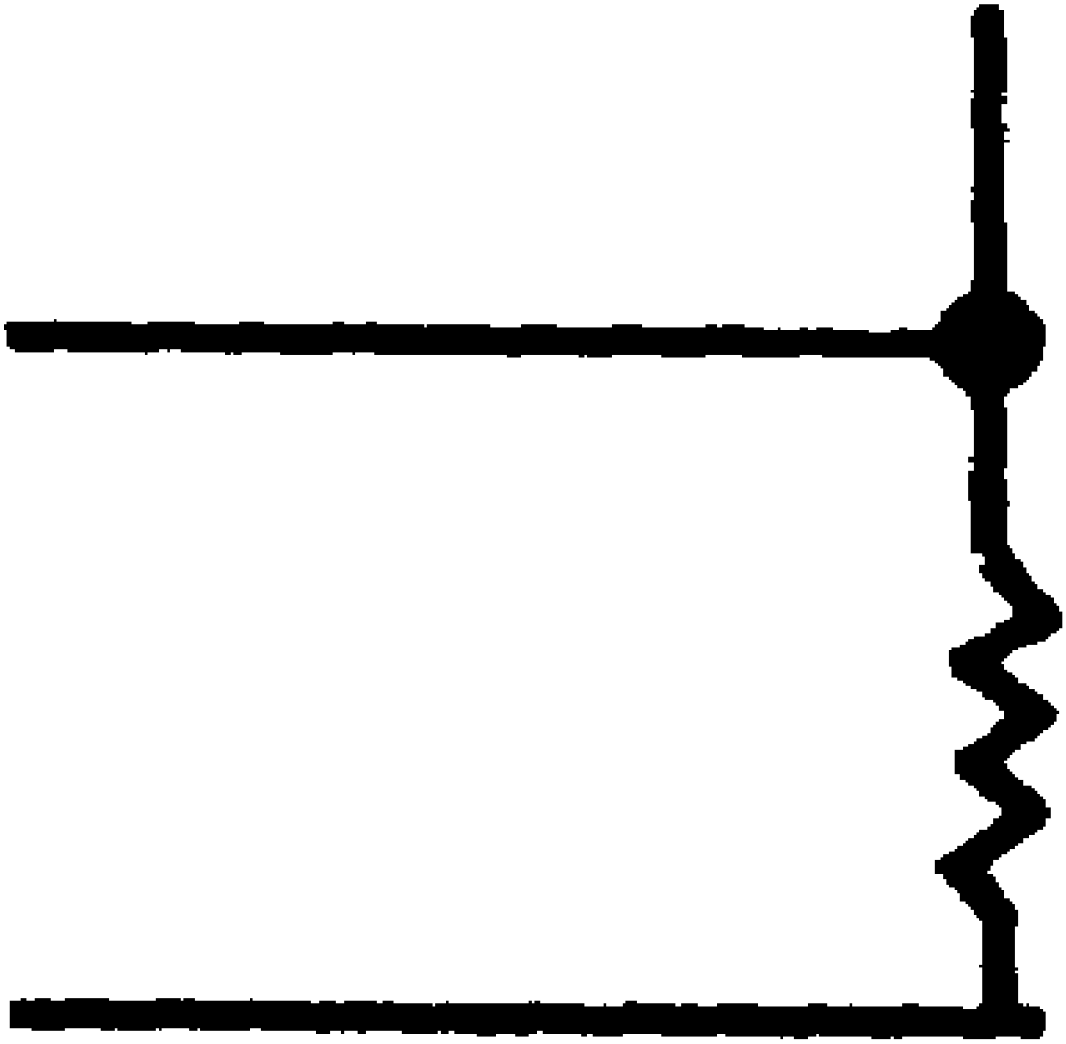
FIG. 3 is a schematic view showing an alternative circuit for a load in an inverter circuit.

Although the above-described embodiment describes the case where a voltage to be fed back to the NMOS N3 is generated in the NMOS N4, the present invention is not limited thereto as long as a voltage drop by a load becomes larger with an increase in current. For example, the same operation as in the above embodiment is possible with the use of a resistance load as shown in FIG. 3.

Figure 4:
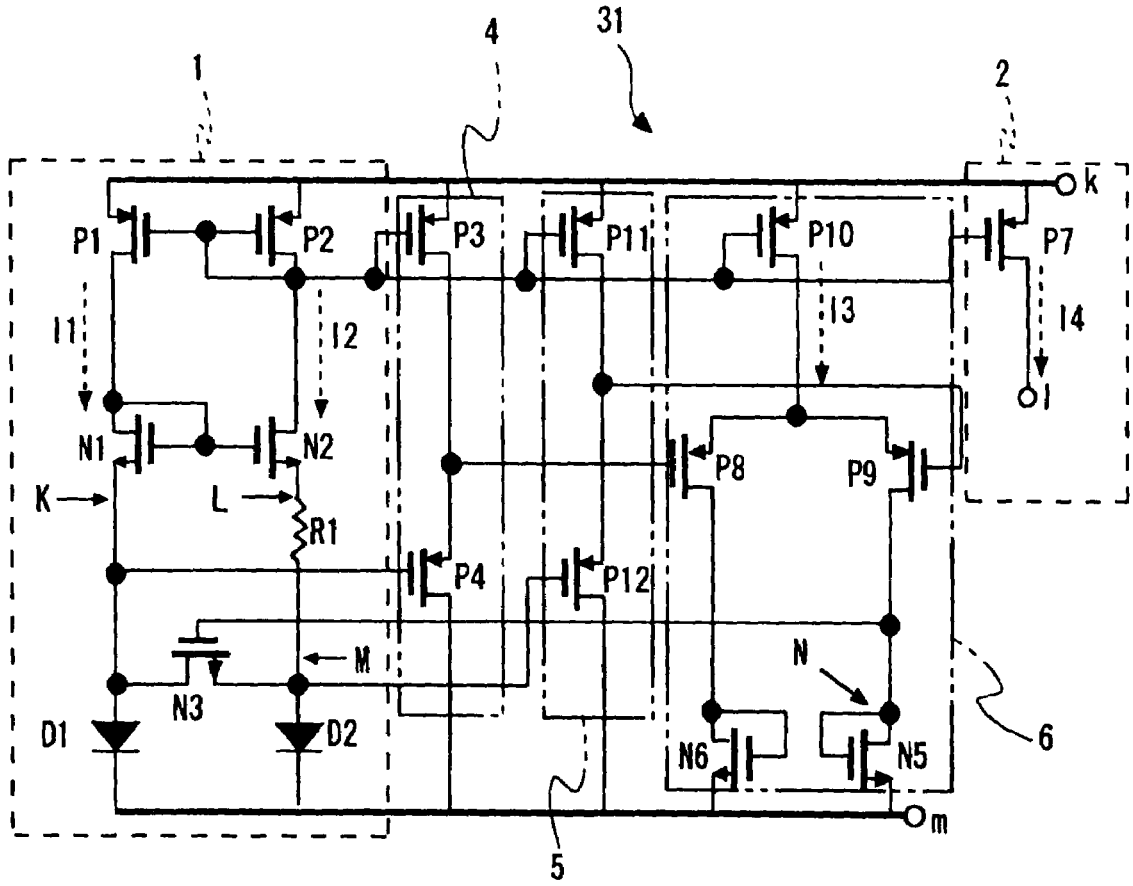
FIG. 4 is a circuit diagram showing a constant current circuit using a differential circuit according to an embodiment of the present invention.

FIG. 4 shows a constant current circuit 31, which is an alternative example for the constant current circuit 30. In FIG. 4, the inverter circuit 3 of the constant current circuit 30 in FIG. 1 is replaced with a differential circuit 6. In the constant current circuit 31 shown in FIG. 4, the same elements as in the constant current circuit 30 are denoted by the same reference symbols and their detailed description is not provided herein.

The constant current circuit 31, which is an alternative example, includes the band-gap reference circuit 1, the current output unit 2, the first level shifter 4, the differential circuit 6, and a second level shifter 5. The gate of the NMOS N3 receives an output voltage of the differential circuit 6, which is described in detail later.

The gate of the PMOS P4 receives a voltage at the anode of the diode D1. A voltage between the PMOS P4 and the PMOS P3 is one input to the differential circuit 6. The gate of a PMOS P12 receives a voltage at the anode of the diode D2. A voltage between the PMOS P12 and a PMOS P11 is the other input to the differential circuit 6.

The differential circuit 6 includes PMOS P8 to P10 and NMOS N5 and N6. The gate of the PMOS P10 is connected with the drain of the PMOS P2 to form a current mirror. The source of the PMOS P10 is connected with the power supply terminal, and the drain of the PMOS P10 is connected with the sources of the PMOS P8 and P9. The PMOS P8 and the NMOS N6 are connected in series between the drain of the PMOS P10 and the ground voltage. The gate of the PMOS P8 is connected with a node between the PMOS P3 and P4. Likewise, the PMOS P9 and the NMOS N5 are connected in series between the drain of the PMOS P10 and the ground voltage. The gate of the PMOS P9 is connected with a node between the PMOS P11 and P12.

The PMOS P1 to P4, the PMOS P7 to P12, the NMOS N1 to N3, N5 and N6 in this alternative example have the same transistor size, and they operate in a saturation region. The transistors which form a current mirror in FIG. 4 may form a current mirror by cascode connection. The first level shifter 4 and the second level shifter 5 may be eliminated depending on threshold setting of transistors.

Figure 5A:
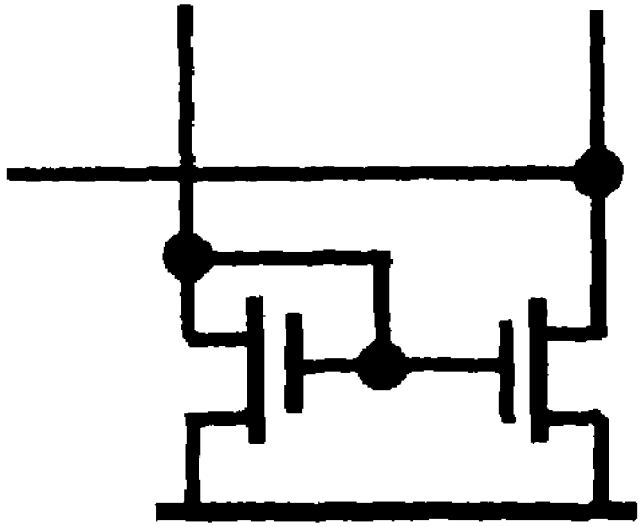
FIG. 5A is a schematic view showing an alternative circuit for a load in a differential circuit.
Figure 5B:
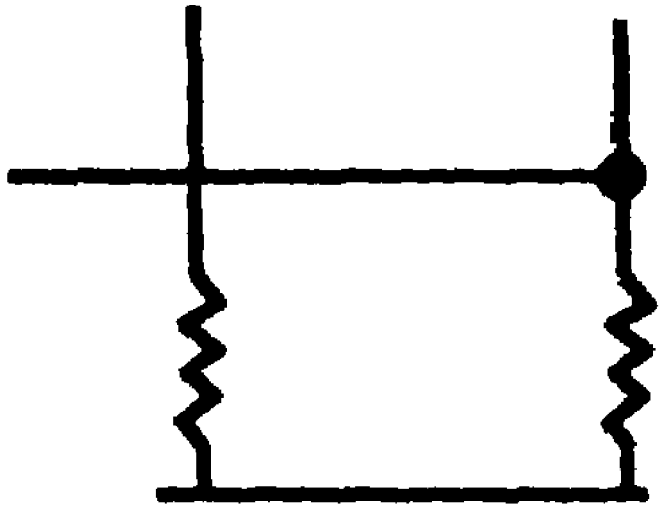
FIG. 5B is a schematic view showing an alternative circuit for a load in a differential circuit.
Figure 6:
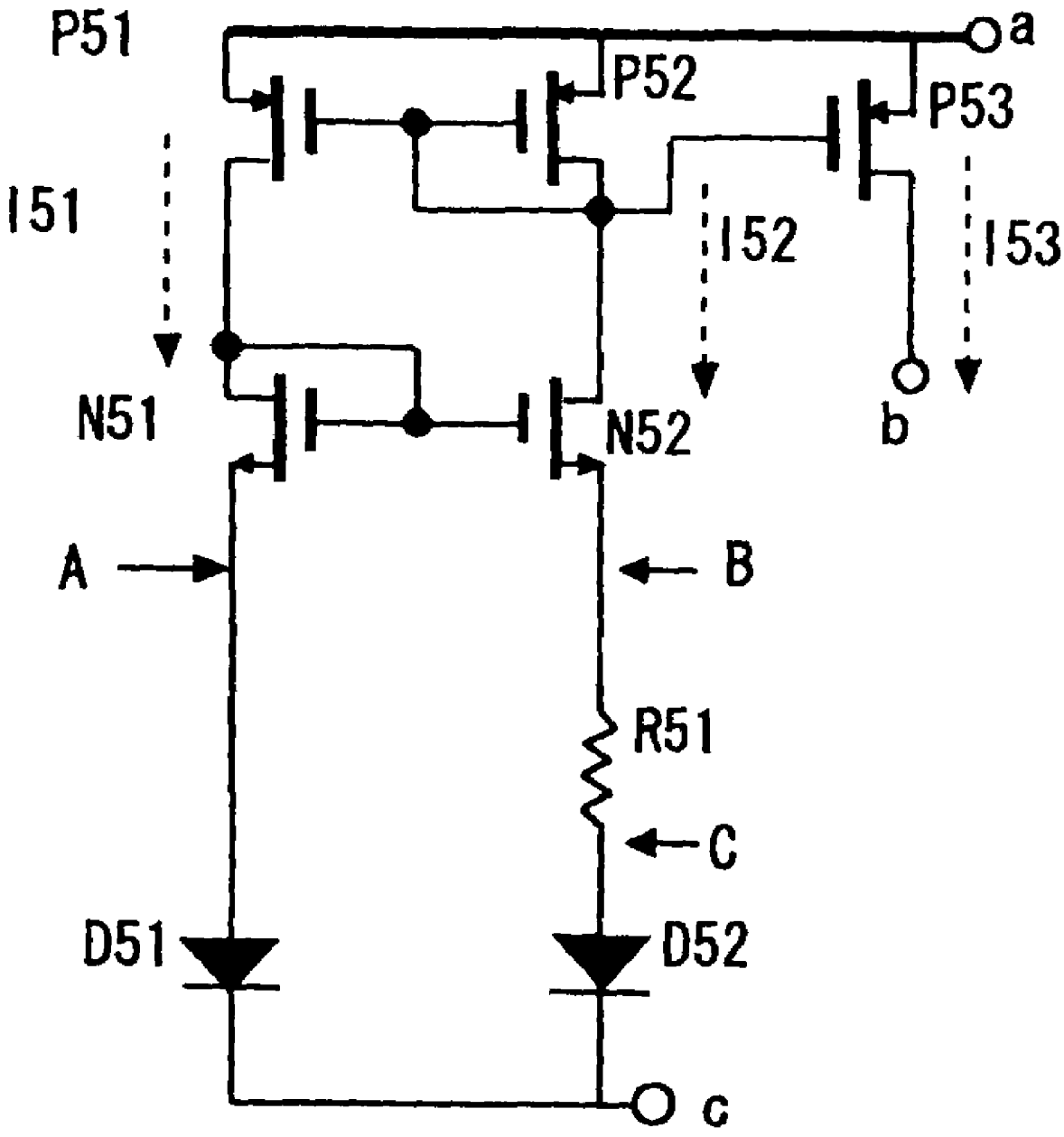
RELATED ART Fig. 6
FIG. 6 is a circuit diagram showing a constant current circuit according to a related art.
Figure 7:
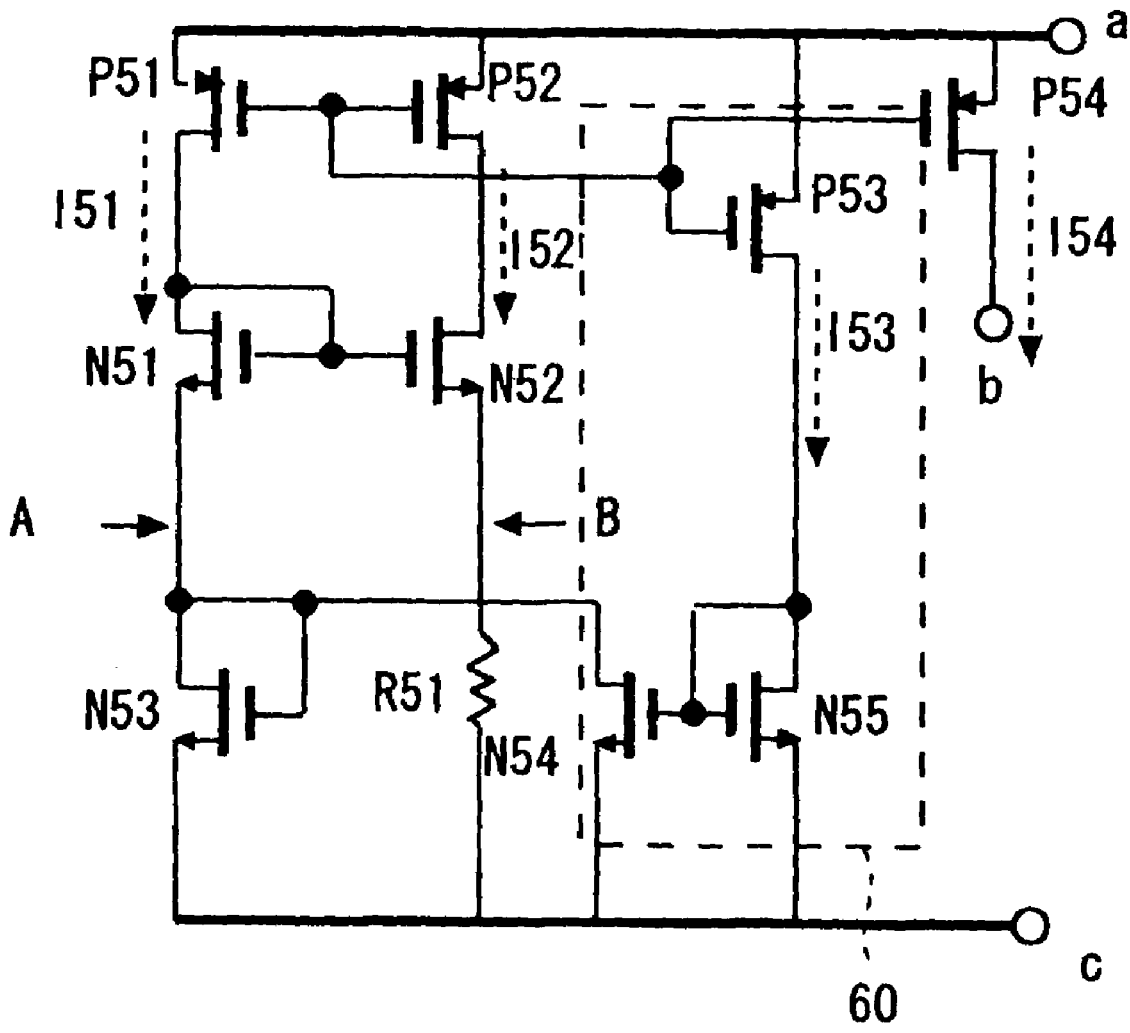
RELATED ART Fig. 7
FIG. 7 is a circuit diagram showing a constant current circuit according to another related art.

The constant current circuit 31 includes the differential circuit 6, which corresponds to the inverter circuit 3 in the constant current circuit 30, as a circuit to generate a voltage to be fed back to the gate of the NMOS N3. Specifically, the constant current circuit 31 generates a voltage VN at the point N on the basis of a difference between a voltage VK at the point K and a voltage VM at the point M using the differential circuit 6. The constant current circuit 31 operates based on a voltage difference between the point K and the point M with the use of the differential circuit 6. Although this alternative example describes the case where a voltage to be fed back to the NMOS N3 is generated in the NMOS N5, the present invention is not limited thereto as long as a voltage drop by a load becomes larger with an increase in current. For example, a current mirror load as shown in FIG. 5A or a resistance load as shown in FIG. 5B may be used instead.

According to the present embodiment, the constant current circuit 30 which includes the inverter circuit 3 generates a voltage on the basis of a voltage at the point M using the inverter circuit 3 and feeds back the generated voltage to the NMOS N3. On the other hand, the constant current circuit 31 which includes the differential circuit 6 generates a voltage on the basis of a voltage difference between the point M and the point K using the differential circuit 6 and feeds back the generated voltage to the NMOS N3. Thus, if there is process fluctuation in resistance of the resistor R1 in the constant current circuit 30 or 31, a voltage corresponding to the process fluctuation is generated in the inverter circuit 3 or the differential circuit 6, and the generated voltage is fed back to the NMOS N3. The feedback of the voltage corresponding to the process fluctuation in resistance of the resistor R1 to the NMOS N3 enables a decrease in variation of the current I2 which flows through the resistor R1. This allows the current I4 output from the constant current circuit 30 to remain substantially constant. It is thereby possible to supply a stable output current with a bias circuit having a small dependence on process fluctuation in resistance. This enables improvement in CMOS circuit characteristics, yield and so on.

It is apparent that the present invention is not limited to the above embodiment but may be modified and changed without departing from the scope and spirit of the invention.

What is claimed is:

1. A constant current circuit, comprising:

a first current mirror including a first transistor formed on a first current path and a second transistor formed on a second current path;

a second current mirror including a third transistor formed on the first current path and a fourth transistor formed on the second current path;

a first diode formed on the first current path;

a second diode formed on the second current path;

a resistor formed on the second current path;

a variable resistance element directly connected with the third transistor and with the resistor; and a feedback unit to control a resistance value of the variable resistance element based on a current flowing through the second current path.

2. The constant current circuit according to claim 1, wherein the variable resistance element includes a transistor.

3. The constant current circuit according to claim 2, wherein the feedback unit includes:

a fifth transistor connected with the second transistor to form a current mirror; and a first load, and the feedback unit generates a voltage to be fed back to the variable resistance element based on a voltage drop in the first load.

4. The constant current circuit according to claim 2, further comprising:

a first level shifter to shift a level of a voltage at a prescribed node on the second current path and output a level-shifted voltage to the feedback unit.

5. The constant current circuit according to claim 2, wherein the feedback unit includes:

a sixth transistor connected with the second transistor to form a current mirror;

a seventh transistor to receive a signal based on a voltage at a prescribed node on the first current path;

an eighth transistor to receive a signal based on a voltage at a prescribed node on the second current path; and a second load connected with the eighth transistor, and the feedback unit generates a voltage to be fed back to the variable resistance element based on a voltage drop in the second load.

6. The constant current circuit according to claim 2, wherein the transistor includes a first node connected to the third transistor and a second node connected to the resistor.

7. The constant current circuit according to claim 1, wherein the feedback unit includes:

a fifth transistor connected with the second transistor to form a current mirror; and a first load, and the feedback unit generates a voltage to be fed back to the variable resistance element based on a voltage drop in the first load.

8. The constant current circuit according to claim 7, further comprising:

a first level shifter to shift a level of a voltage at a prescribed node on the second current path and output a level-shifted voltage to the feedback unit.

9. The constant current circuit according to claim 1, further comprising:

a first level shifter to shift a level of a voltage at a prescribed node on the second current path and output a level-shifted voltage to the feedback unit.

10. The constant current circuit according to claim 1, wherein the feedback unit includes:

a sixth transistor connected with the second transistor to form a current mirror;

a seventh transistor to receive a signal based on a voltage at a prescribed node on the first current path;

an eighth transistor to receive a signal based on a voltage at a prescribed node on the second current path; and a second load connected with the eighth transistor, and the feedback unit generates a voltage to be fed back to the variable resistance element based on a voltage drop in the second load.

11. The constant current circuit according to claim 10, further comprising:

a second level shifter to shift a level of a voltage at the prescribed node on the first current path and output a level-shifted voltage to the feedback unit; and a third level shifter to shift a level of a voltage at the prescribed node on the second current path and output a level-shifted voltage to the feedback unit.

12. A constant current circuit, comprising:

a first diode;

a second diode;

a resistor coupled to a first terminal of the second diode;

first and second transistors of a first conductivity type, control gates of the first and second transistors being connected to each other, the first transistor being coupled to the first diode, the second transistor being coupled to a second terminal of the resistor;

third and fourth transistors of a second conductivity type, control gates of the third and fourth transistors being connected to each other, the third transistor being coupled to the first transistor, the fourth transistor being coupled to the second transistor;

a variable resistance element coupled between a first crossing node of the first diode and the first transistor and a second crossing node of the resistor and the second diode; and a feedback unit which controls to reduce a resistance value of the variable resistance element when a current obtained by the third and fourth transistors becomes larger, in order to reduce a voltage potential difference at the first crossing node and the second crossing node.

13. The constant current circuit according to claim 12, wherein the variable resistance element includes a transistor which has a first node connected to the first crossing node, a second node connected to the second crossing node, and a control gate controlled by a signal from the feedback unit.

14. The constant current circuit according to claim 12, wherein the first and second transistors are connected in a current mirror structure, and the third and fourth transistors are connected in a current mirror structure.

* * * * *